US008919435B2

(12) United States Patent
Greci et al.

(10) Patent No.: US 8,919,435 B2
(45) Date of Patent: Dec. 30, 2014

(54) DEHYDRATOR SCREEN FOR DOWNHOLE GRAVEL PACKING

(75) Inventors: Stephen Michael Greci, McKinney, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/883,179

(22) PCT Filed: May 10, 2012

(86) PCT No.: PCT/US2012/037217

§ 371 (c)(1), (2), (4) Date: May 2, 2013

(87) PCT Pub. No.: WO2013/169254

PCT Pub. Date: Nov. 14, 2013

(65) Prior Publication Data

US 2013/0341006 A1 Dec. 26, 2013

(51) Int. Cl.

| | |
|---|---|
| ***E21B 43/00*** | (2006.01) |
| ***E21B 43/04*** | (2006.01) |
| ***E21B 41/00*** | (2006.01) |
| ***E21B 43/08*** | (2006.01) |

(52) U.S. Cl.

CPC ..... *E21B 41/00* (2013.01); *E21B 43/04* (2013.01); *E21B 43/086* (2013.01); *E21B 43/088* (2013.01)

USPC ..... 166/227; 166/51; 166/230

(58) Field of Classification Search

CPC ..... B01D 29/58; B01D 39/10; E21B 43/088; E21B 34/06

USPC ..... 166/51, 56, 157, 227, 228, 230, 232, 166/235, 236, 234

See application file for complete search history.

(56) References Cited

U.S. PATENT DOCUMENTS

| | | | | |
|---|---|---|---|---|
| 5,392,850 | A | 2/1995 | Cornette et al. | |
| 5,642,781 | A * | 7/1997 | Richard | 166/231 |
| 5,673,752 | A * | 10/1997 | Scudder et al. | 166/265 |
| 5,980,745 | A * | 11/1999 | Voll et al. | 210/497.01 |
| 6,830,104 | B2 | 12/2004 | Nguyen et al. | |
| 7,413,022 | B2 * | 8/2008 | Broome et al. | 166/386 |
| 7,866,383 | B2 * | 1/2011 | Dusterhoft et al. | 166/227 |
| 7,987,909 | B2 * | 8/2011 | Pineda et al. | 166/278 |
| 8,146,662 | B2 * | 4/2012 | Shoemate | 166/278 |
| 8,499,827 | B2 * | 8/2013 | Dusterhoft et al. | 166/227 |
| 2003/0173075 | A1 * | 9/2003 | Morvant et al. | 166/230 |
| 2006/0237197 | A1 | 10/2006 | Dale et al. | |
| 2011/0011586 | A1 * | 1/2011 | Dusterhoft et al. | 166/278 |
| 2011/0297376 | A1 * | 12/2011 | Holderman et al. | 166/278 |

FOREIGN PATENT DOCUMENTS

EP 2383431 11/2011

OTHER PUBLICATIONS

International Application No. PCT/US2012/037217, "International Search Report and Written Opinion", Feb. 25, 2013 (10 Pages).

* cited by examiner

*Primary Examiner* — Kenneth L Thompson
*Assistant Examiner* — Michael Wills, III
(74) *Attorney, Agent, or Firm* — Kilpatrick Townsend & Stockton LLP

(57) ABSTRACT

Certain aspects and features relate to dehydrator screens that are inexpensively made wire, mesh, or stamped metal screens that can direct carrier fluid from a gravel pack slurry efficiently to one or more screens associated with a base pipe.

16 Claims, 4 Drawing Sheets

DEHYDRATOR SCREEN FOR DOWNHOLE GRAVEL PACKING

CROSS-REFERENCE TO RELATED APPLICATIONS

This is a U.S. national phase under 35 U.S.C. 371 of International Patent Application No. PCT/US2012/037217, titled "Dehydrator Screen for Downhole Gravel Packing," filed May 10, 2012, the entirety of which is incorporated herein by reference.

TECHNICAL FIELD OF THE INVENTION

The present invention relates generally to dehydrator screens in wellbores in subterranean formations and, more particularly (although not necessarily exclusively), to a dehydrator screen that can direct fluid from a gravel pack slurry to a main screen associated with a base pipe in the wellbore.

BACKGROUND

Various devices can be installed in a wellbore traversing a hydrocarbon-bearing subterranean formation. For example, screens can be positioned with sections of base pipe in a wellbore. The screens can filter particulate material from fluid prior to the fluid being received by an inner section of the base pipe. Another example is gravel packs that may be provided downhole in a slurry that includes a carrier fluid, gravel and other material. The gravel packs may be positioned between a base pipe and components associated with a base pipe and an inner wall of the wellbore to provide support or other functions.

Carrier fluid is removed from the slurry for a gravel pack to form downhole. The screens may allow the carrier fluid to drain from the slurry to create the gravel pack. It can be difficult to create a gravel pack, however, between screens and around a coupling between portions of a base pipe since fluid drainage may be limited or non-existent in those areas. Drainage tubes may be used to provide an alternate path for carrier fluid to drain from these areas, for example. The drainage tubes include precision-cut slots and can allow carrier fluid to drain from those areas to the screens.

Drainage tubes are made by making precise cuts using a laser to a tubing to create slots. Precise cuts are expensive, time intensive, and may result in a flow area of less than desirable size.

Accordingly, devices and assemblies are desirable that can filter and direct carrier fluid from a gravel pack slurry using a more desirable flow area and avoiding precise cuts.

SUMMARY

Certain aspects of the present invention are directed to a dehydrator screen that can direct fluid from a gravel pack slurry toward one or more main screens and that are made while avoiding precise cuts.

One aspect relates to an assembly that includes a dehydrator screen. The dehydrator screen can be positioned exterior to a base pipe in a wellbore. The dehydrator screen can direct fluid from a gravel pack slurry exterior to the base pipe toward a main screen that is associated with the base pipe. The dehydrator screen includes openings and is formed from at least one of stamped metal, wire wrap, or mesh material.

Another aspect relates to an assembly that includes a base pipe, at least two main screens, and a dehydrator screen. The main screens can circumferentially surround portions of the base pipe in the wellbore. The dehydrator screen includes an elongated element, openings in the elongated element, and at least two sealed ends. The dehydrator screen is (i) positionable exterior to part of the base pipe and the main screens in the wellbore and (ii) adapted for directing fluid from a gravel pack slurry exterior to the base pipe toward at least one of the main screens.

Another aspect relates to a dehydrator screen that includes an elongated element, openings in the surface of the elongated element, and sealed ends. The dehydrator screen is positionable in a wellbore exterior to a base pipe and a main screen associated with the base pipe. The dehydrator screen is adapted for directing fluid from a gravel pack slurry exterior to the base pipe toward the main screen.

These illustrative aspects are mentioned not to limit or define the invention, but to provide examples to aid understanding of the inventive concepts disclosed herein. Other aspects, advantages, and features of the present invention will become apparent after review of the entire document and drawings.

DETAILED DESCRIPTION

Certain aspects and features relate to dehydrator screens that are inexpensively made wire, stamped metal, or mesh screens that can direct carrier fluid from a gravel pack slurry efficiently to one or more screens associated with a base pipe. Dehydrator screens according to some aspects can be any shape, easy and inexpensive to manufacture, increase flow area by twenty to thirty percent, and increase efficiency of dehydration or filtering of carrier fluid from a gravel pack slurry.

One example of a dehydrator screen is a wire screen that may act as a drainage tube or be used with a drainage tube. The wire screen may be a wire wrap tube or other elongated member with two ends and openings in an outer surface. Both ends can be sealed by welding plates to the ends, shrink caps on the ends, or crush each end and weld any gap. Sealed ends may help direct fluid toward one or more other screens that may be main screens of a downhole assembly.

Another example of a dehydrator screen is a mesh screen that includes a mesh material seam welded to form a tube or other elongated member. The ends of the mesh screen may or may not be sealed.

Another example of a dehydrator screen is a screen formed by stamping a strip of metal, such as by using a louvered-type stamp, to create punched openings. The size and shape of the openings can be controlled through stamping. The metal strip can be formed into a tube or other shaped elongated member by helically welding the metal strip or by rolling the metal strip longitudinally and welding the seam. The ends of the tube or other elongated member can be sealed in ways similar to the wire screen described above.

Certain aspects provide a dehydrator screen that can be made anywhere, even at a wellbore site, at low cost, and can be made to a customized length for a given application. A dehydrator screen according to various aspects can avoid the need for precisely cut slots. Certain dehydrator screens can allow openings in the surface of the dehydrator screens to be adjusted, such as depending on the type or size of gravel.

These illustrative examples are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative embodiments but, like the illustrative embodiments, should not be used to limit the present invention.

Figure 1:
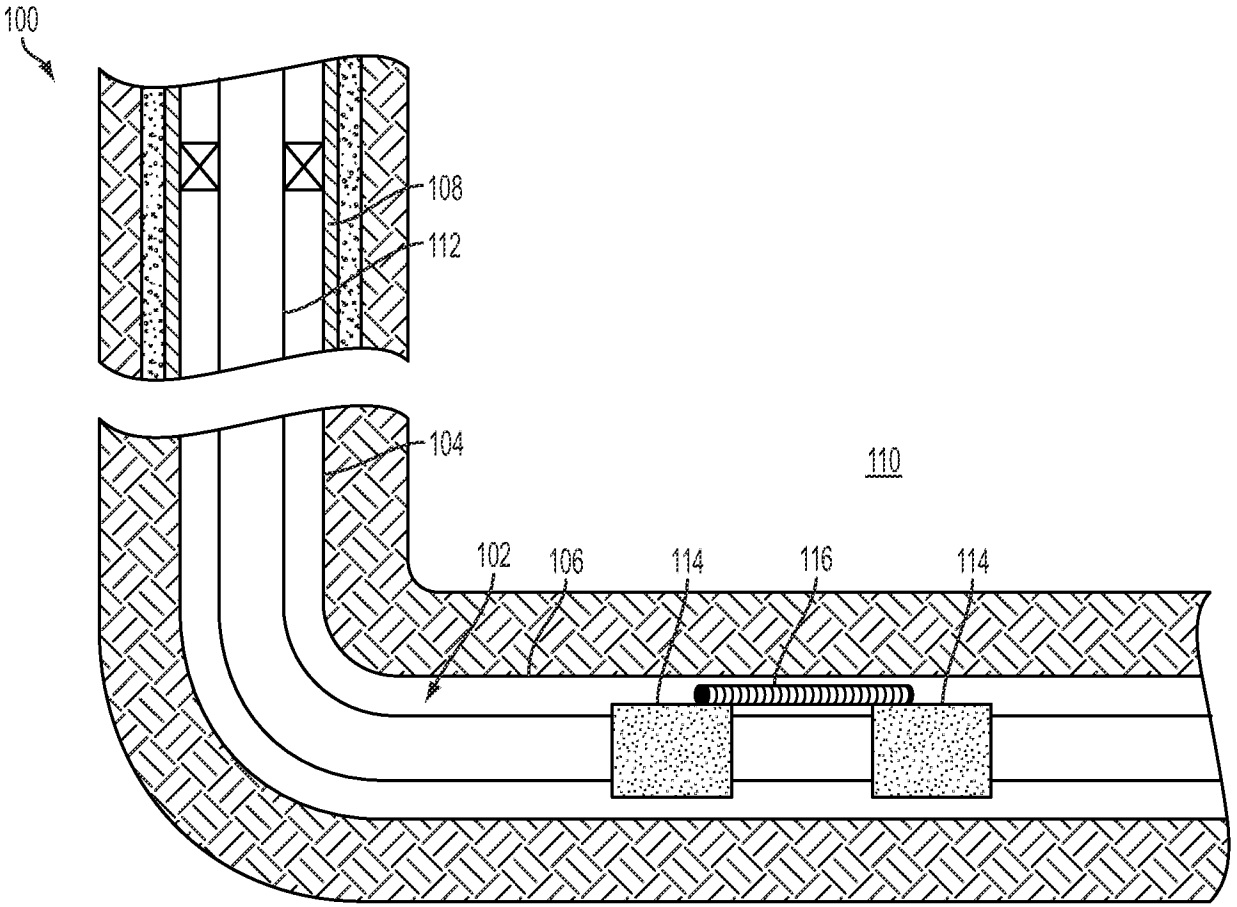
FIG. 1 is a schematic illustration of a well system having an assembly that includes a dehydrator screen according to one example.

FIG. 1 depicts a well system 100 with a dehydrator screen 116 according to one aspect of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 that is a base pipe extends from the surface within wellbore 102. The tubing string 112 can provide a conduit for carrier and formation fluids to travel from the substantially horizontal section 106 to the surface. Screens 114 are positioned circumferential to portions of the tubing string 112 to define intervals. The dehydrator screen 116 is positioned exterior to the tubing string 112. The dehydrator screen 116 is depicted as being proximate to both screens 114. In other examples, the dehydrator screen 116 is proximate to one, but not both screens 114, or otherwise positioned with respect to one or more of the screens 114.

A gravel pack slurry may be provided down the wellbore 102 to the screens 114. The dehydrator screen 116 can direct carrier fluid away from the gravel pack slurry, even the slurry between the screens 114, to one or more of the screens 114 such that the carrier fluid is substantially removed from the gravel pack slurry.

Although FIG. 1 depicts screens 114 and the dehydrator screen 116 positioned in the substantially horizontal section 106, screens 114 and the dehydrator screen 116 according to other examples can be located, additionally or alternatively, in the substantially vertical section 104. Furthermore, any number of screens 114 and dehydrator screens 116, including one of each, can be used in the well system 100 generally. In some embodiments, screens 114 and the dehydrator screen 116 can be positioned in simpler wellbores, such as wellbores having only a substantially vertical section. Screens 114 and the dehydrator screen 116 can be positioned in open hole environments, such as is depicted in FIG. 1, or in cased wells.

Figure 2:
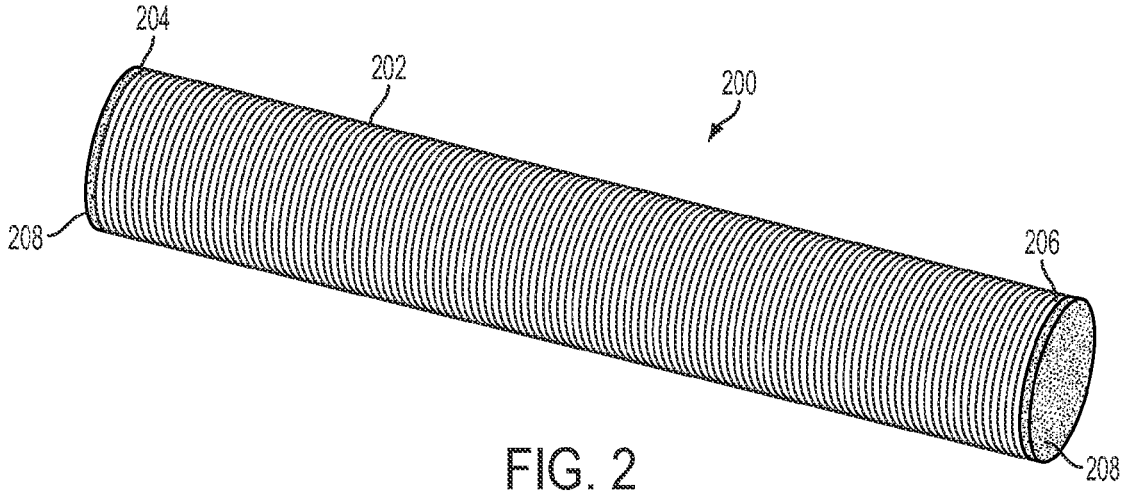
FIG. 2 is a perspective view of a dehydrator screen that is a wire wrap screen according to one example.
Figure 3:
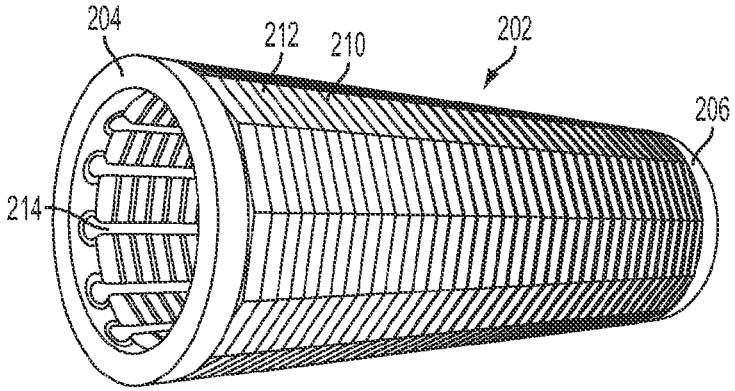
FIG. 3 is a perspective view of the dehydrator screen of FIG. 2 without a capped end according to one example.
Figure 4:
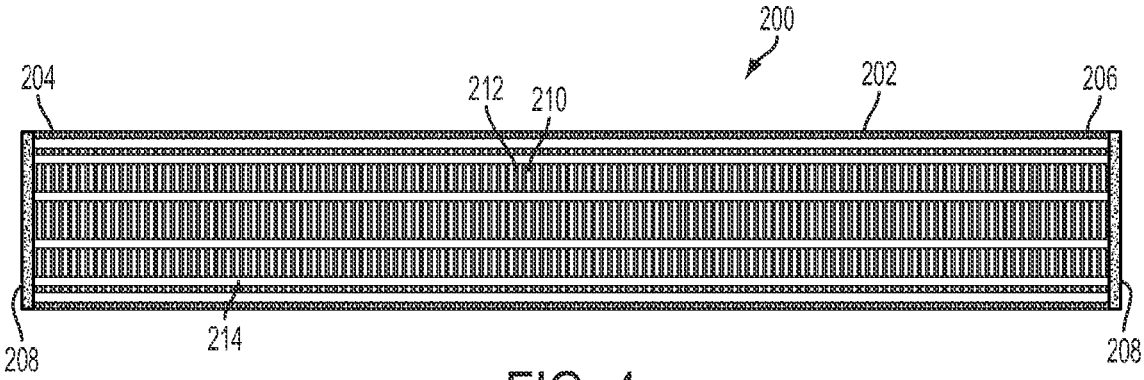
FIG. 4 is a side view of the dehydrator screen of FIG. 2 according to one example.
Figure 5:
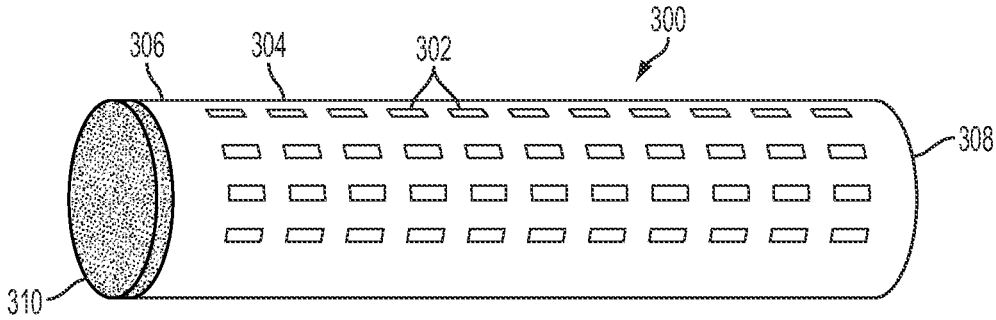
FIG. 5 is a perspective view of a dehydrator screen that includes punched openings according to another example.

FIGS. 2-4 depict an example of a dehydrator screen 200 that is a wire screen. The wire screen may be formed from a wire wrap tube 202 with ends 204, 206 sealed by a sealing mechanism 208. The sealing mechanism 208 may include plates welded on each of the ends 204, 206 (as shown in FIGS. 2 and 4). Other examples of the sealing mechanism 208 include shrinking caps on each of the ends 204, 206 and crushing each of the ends 204, 206 and welding any gap.

The wire wrap tube 202 includes wires 210 with openings 212 between the wires 210. Framing wires 214, shown in FIG. 3 with the sealing mechanism removed and in the side view cross-section of FIG. 4, may be located in an inner region of the wire wrap tube 202 to provide stability to the dehydrator screen structure.

The openings 212 can allow carrier fluid from a gravel pack slurry to enter the inner region of the wire wrap tube 202 and be directed toward one or more main screens with respect to which the dehydrator screen is positioned, as shown for example in FIG. 1.

Figure 6:
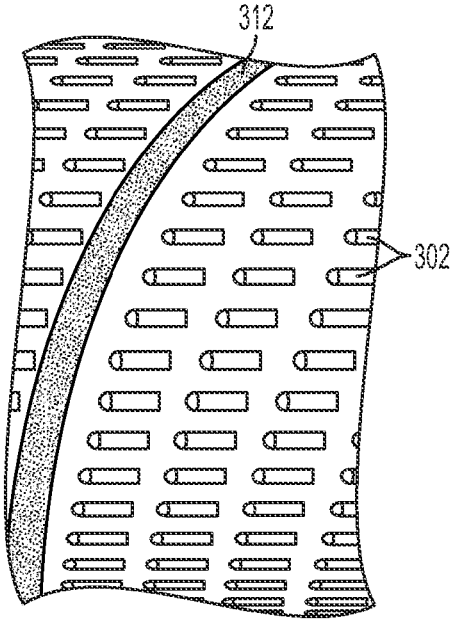
FIG. 6 is a close-up view of the surface of the dehydrator screen of FIG. 5 according to one example.

FIGS. 5-8 depict another example of a dehydrator screen 300 that is formed from stamped metal. The dehydrator screen 300 includes punched openings 302 formed by stamping a metal strip and forming the metal strip into a tube 304, shroud, or other elongated structure. The ends 306, 308 can be sealed using a sealing mechanism 310, such as those described above in connection with FIGS. 2 and 4. In one example, the punched openings 302 can be formed using a louvered-type stamp on a metal strip that is a shroud. The metal strip can be rolled and a seam welded to form the tube or other elongated structure. FIG. 6 is a close-up view of a surface of the dehydrator screen 300 that includes punched openings 302 and a welded seam 312.

Figure 7:
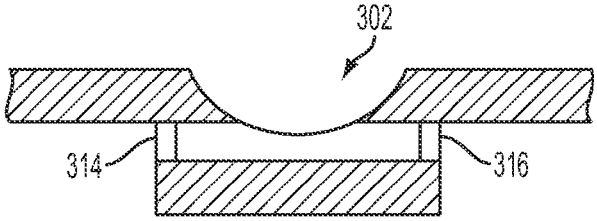
FIG. 7 is a schematic side view of a punched portion of the dehydrator screen of FIG. 5 according to one example.
Figure 8:
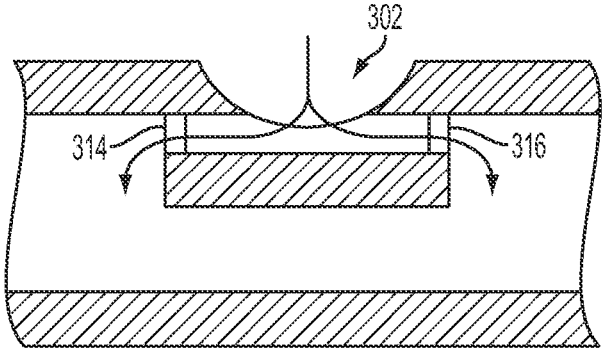
FIG. 8 is a schematic side view of a portion of the punched dehydrator screen with direction of fluid flow according to one example.

FIG. 7 depicts an example of a punched opening 302. The punched opening 302 includes two gaps 314, 316 formed after the metal strip is punched. The gaps 314, 316 can allow fluid to enter an inner region of the dehydrator screen, as shown in FIG. 8, and directed towards one or more main screens.

Figure 9:
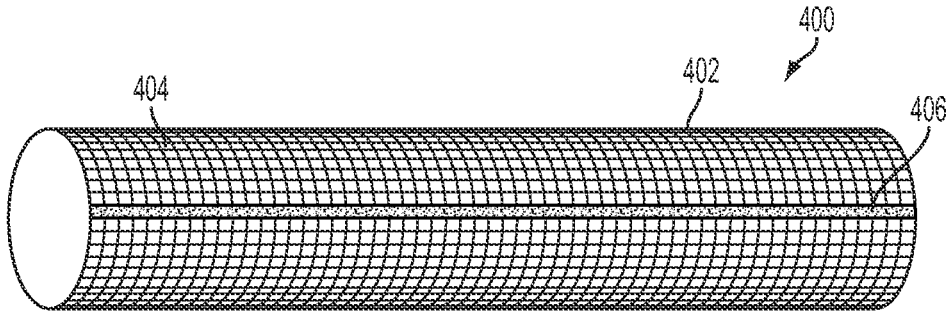
FIG. 9 is a perspective view of a dehydrator screen that is mesh according to another example.
Figure 10:
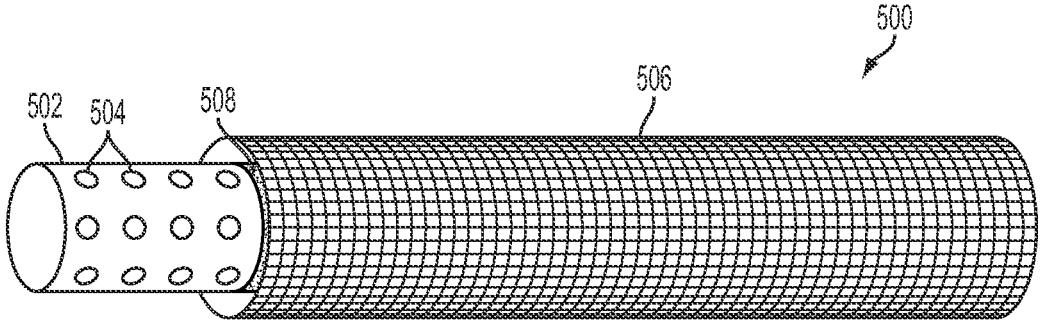
FIG. 10 is a perspective view of a dehydrator screen that is a shroud coupled to mesh according to another example.
Figure 11:
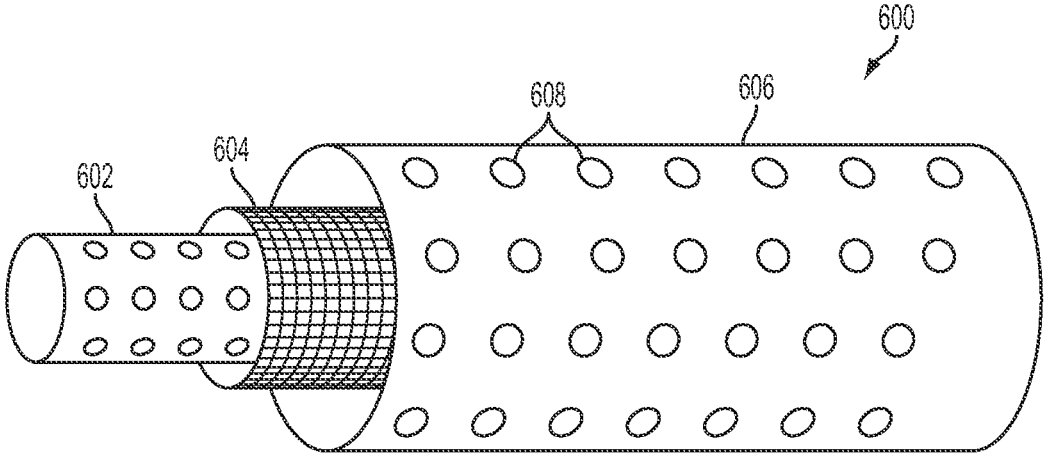
FIG. 11 is a perspective view of a dehydrator screen that includes a first shroud, mesh, and a second shroud according to another example.

Dehydrator screens according to other aspects may be formed using mesh. Mesh material may be interweaved or interlaced material forming a structure having openings. FIGS. 9-11 depict examples of dehydrator screens at least partially formed using mesh.

FIG. 9 depicts a dehydrator screen 400 that includes an elongated element 402 of mesh material 404. The mesh material 404 can be rolled and coupled using a mechanism such as a welded seam 406 to form the elongated element. The mesh material 404 includes openings through which carrier fluid from a gravel pack slurry can be received and directed towards one or more main screens. The ends of dehydrator screen 400 may or may not be sealed. If the ends are sealed, the ends can be sealed using any suitable sealing mechanism, such as those discussed above.

FIG. 10 is a dehydrator screen 500 that includes two elongated elements. The first elongated element 502 can be formed by stamping a strip of metal to form punched openings 504 and rolling or otherwise coupling the strip of metal together. The second elongated element 506 can be formed from mesh material as in FIG. 9 and can circumferentially surround at least part of the first elongated element 502. In other examples, the second elongated element 506 completely surrounds the first elongated element 502. The second elongated element 506 can be coupled to the first elongated element 502 via a weld 508 or other suitable mechanism.

The ends of each of the first elongated element 502 and the second elongated element 506 may or may not be sealed. In some examples, the ends of the first elongated element 502 are not sealed and the ends of the second elongated element 506 are sealed.

Openings in the mesh material of the second elongated element 506 can allow carrier fluid from a gravel pack slurry to flow to openings in the first elongated element 502 and be received in an inner region of the first elongated element 502. The dehydrator screen 500 can direct the fluid toward one or more main screens.

FIG. 11 is a dehydrator screen 600 that includes three elongated elements. The first elongated element 602 and the second elongated element 604 may be similar to the first elongated element 502 and the second elongated element 506 of FIG. 10, except that the first elongated element 502 and the second elongated element 506 are not welded together. The third elongated element 606 partially or completely surrounds the first elongated element 602 and the second elongated element 604. The third elongated element 606 can be formed by stamping a strip of metal to form punched openings 608 and rolling or otherwise coupling the strip of metal together.

The ends of each of the first elongated element 602, the second elongated element 604, and the third elongated element 606 may or may not be sealed.

The dehydrator screen 600 can filter carrier fluid from a gravel pack slurry and allow the fluid to flow to an inner region defined by the first elongated element 602, and direct the fluid toward one or more main screens.

The foregoing description of certain features, including illustrated features, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly, comprising:

a dehydrator screen configured to be positioned exterior to a base pipe in a wellbore, wherein the dehydrator screen comprises:

a first end that is sealed and a second end that is sealed, an elongated element formed from at least one of stamped metal, wire wrap or mesh material, a plurality of openings in the elongated element, and a mesh element circumferentially surrounding at least part of the elongated element, the mesh element comprising a second plurality of openings adapted for directing fluid from a gravel pack slurry exterior to the base pipe toward a main screen that is associated with the base pipe.

2. The assembly of claim 1, wherein the elongated element is formed from the stamped metal, wherein the plurality of openings comprise a plurality of punched openings in an outer surface of the elongated element.

3. The assembly of claim 2, wherein the plurality of punched openings in the outer surface of the elongated element is configured for allowing fluid to enter and exit the dehydrator screen.

4. The assembly of claim 1, wherein the dehydrator screen comprises a second elongated element circumferentially surrounding at least part of the mesh element, the second elongated element comprising a third plurality of openings that are punched openings, wherein the plurality of punched openings, the second plurality of openings, and the third plurality of openings are adapted to allow fluid to flow to an inner region defined by the elongated element.

5. The assembly of claim 1, wherein the main screen comprises at least two main screens configured for circumferentially surrounding portions of the base pipe in the wellbore, wherein the dehydrator screen is positionable exterior to the at least two main screens in the wellbore.

6. An assembly, comprising:

a base pipe;

at least two main screens configured for circumferentially surrounding portions of the base pipe in a wellbore; and a dehydrator screen comprising:

an elongated element;

a plurality of openings in the elongated element;

a mesh element circumferentially surrounding at least part of the elongated element, the mesh element comprising a second plurality of openings; and at least two sealed ends, wherein the dehydrator screen is (i) positionable exterior to part of the base pipe and the main screens in the wellbore and (ii) adapted for directing fluid from a gravel pack slurry exterior to the base pipe toward at least one of the main screens via at least the second plurality of openings.

7. The assembly of claim 6, wherein the elongated element is made from at least one of stamped metal, wire wrap or mesh material.

8. The assembly of claim 6, wherein the elongated element comprises stamped metal, wherein the plurality of openings comprise a plurality of punched openings in an outer surface of the elongated element.

9. The assembly of claim 6, wherein the dehydrator screen comprises a second elongated element circumferentially surrounding at least part of the mesh element, the second elongated element comprising a third plurality of openings that are punched openings, wherein the plurality of punched openings, the second plurality of openings, and the third plurality of openings are adapted to allow fluid to flow to an inner region defined by the elongated element.

10. A dehydrator screen comprising:

an elongated element;

a plurality of openings in a surface of the elongated element;

a mesh element circumferentially surrounding at least part of the elongated element, the mesh element comprising a second plurality of openings; and sealed ends, wherein the dehydrator screen is positionable in a wellbore exterior to a base pipe and a main screen associated with the base pipe, wherein the dehydrator screen is adapted for directing fluid from a gravel pack slurry exterior to the base pipe toward the main screen via at least the second plurality of openings.

11. The dehydrator screen of claim 10, wherein the elongated element is made from at least one of stamped metal, wire wrap or mesh material.

12. The dehydrator screen of claim 10, wherein the elongated element comprises stamped metal, wherein the plurality of openings comprise a plurality of punched openings in an outer surface of the elongated element.

13. The dehydrator screen of claim 12, wherein the stamped metal comprises a metal strip, wherein the plurality of punched openings comprise louvered-type stamped openings.

14. The dehydrator screen of claim 10, wherein the dehydrator screen comprises a second elongated element circumferentially surrounding at least part of the mesh element, the second elongated element comprising a third plurality of openings that are punched openings, wherein the plurality of punched openings, the second plurality of openings, and the third plurality of openings are adapted to allow fluid to flow to an inner region defined by the elongated element.

15. The dehydrator screen of claim 10, wherein the main screen comprises at least two main screens configured for circumferentially surrounding portions of the base pipe in the wellbore, wherein the dehydrator screen is positionable exterior to the at least two main screens in the wellbore.

16. The dehydrator screen of claim 10, wherein the sealed ends comprise plates welded on each end.

* * * * *